United States Patent [19]

Politzer et al.

[11] Patent Number: 4,535,676

[45] Date of Patent: Aug. 20, 1985

[54] COOLING ARRANGEMENT FOR THE GUN BARRELS OF FIREARMS

[75] Inventors: Anton Politzer, Lauf; Roland Bertiller, Schramberg, both of Fed. Rep. of Germany

[73] Assignee: Diehl GmbH & Co., Nuremberg, Fed. Rep. of Germany

[21] Appl. No.: 433,272

[22] Filed: Oct. 7, 1982

[30] Foreign Application Priority Data

Nov. 19, 1981 [DE] Fed. Rep. of Germany ..... 3145764

[51] Int. Cl.[3] ..... F41F 17/14

[52] U.S. Cl. ..... 89/14.1; 89/155

[58] Field of Search ..... 89/14.1, 155, 156, 157

[56] References Cited

U.S. PATENT DOCUMENTS

| | | | |
|---|---|---|---|
| 1,070,826 | 8/1913 | Lung | 89/13 R |
| 2,641,162 | 6/1953 | Balleisen | 89/14.1 |
| 2,764,914 | 10/1956 | Young | 89/14.1 |
| 2,801,575 | 8/1957 | Grover | 89/14.1 |

FOREIGN PATENT DOCUMENTS

| | | | |
|---|---|---|---|
| 2110352 | 6/1983 | United Kingdom | 89/14.1 |

*Primary Examiner*—Stephen C. Bentley
*Assistant Examiner*—John S. Maples
*Attorney, Agent, or Firm*—Scully, Scott, Murphy & Presser

[57] ABSTRACT

A cooling arrangement for the gun barrels of firearms, in particular automatic firearms and high-performance machine cannons. The arrangement includes radially outwardly directed cooling pasageways between the individual projectile chambers provided in the drum in the region of the end portion of the gun barrel axially adjoining the drum, and which are connected with a main passageway in the hollow-bored longitudinal barrel axis for the central cooling medium infeed. Connected to the nozzles of the radially directed passageways, which nozzles extend essentially in parallel with the longitudinal axis of the drum, closure members are interposed in the radial cooling passageways which automatically open and close in dependence upon the drum position and only during firing, whereby the outlet openings of the nozzles positioned in the axial end surface of the drum and, during rotation of the drum, will presently openly communicate for a short period of time with the associated end portion of the gun barrel.

9 Claims, 5 Drawing Figures

Fig. 1
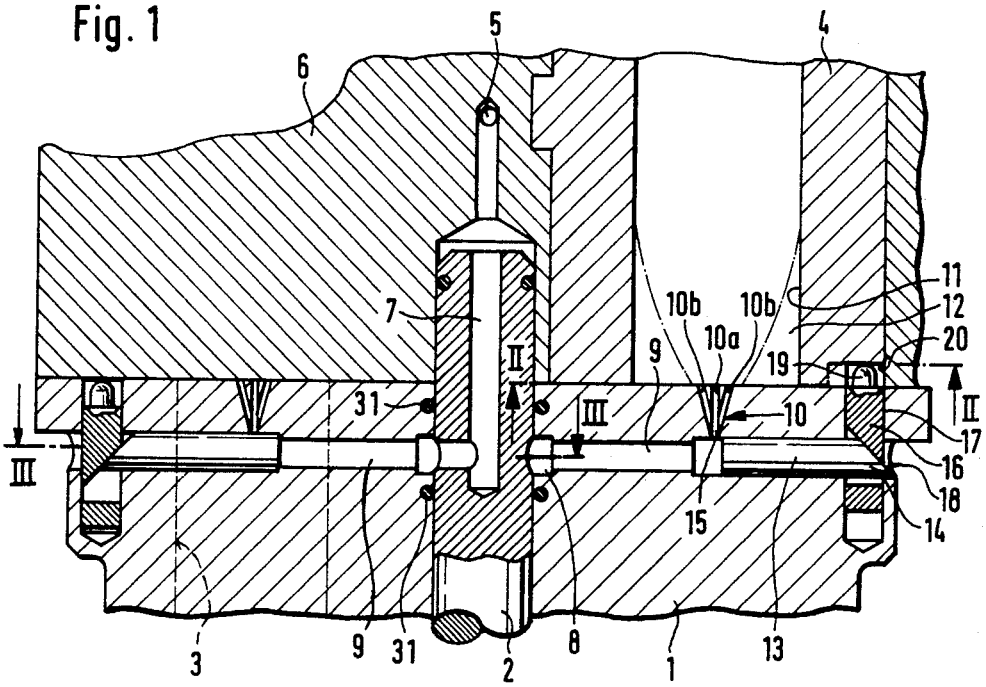
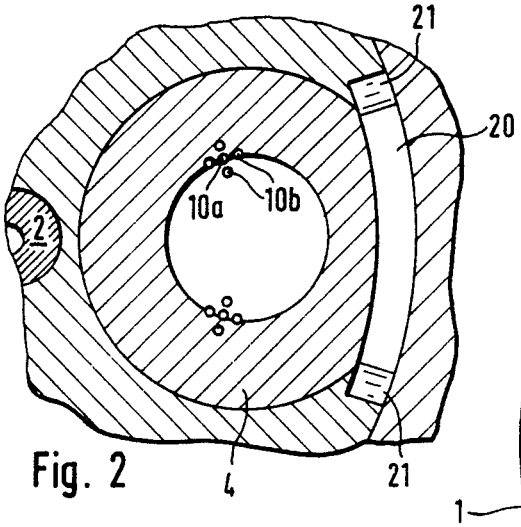
Fig. 2
Fig. 3
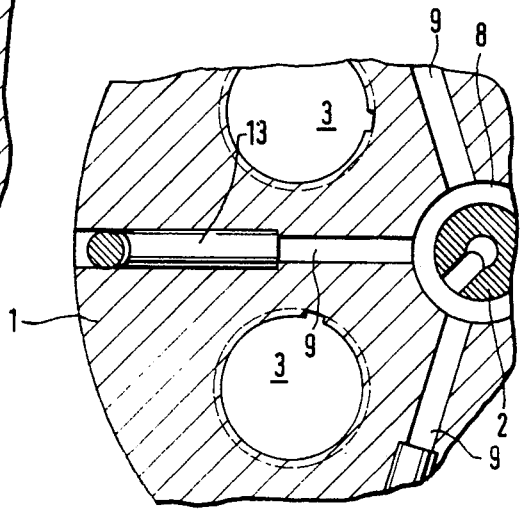

COOLING ARRANGEMENT FOR THE GUN BARRELS OF FIREARMS

BACKGROUND OF THE INVENTION

1. Field of the Invention

The present invention relates to a cooling arrangement for the gun barrels of firearms, in particular automatic firearms and high-performance machine cannons, which includes radially outwardly directed cooling passageways between the individual projectile chambers provided in the drum in the region of the end portion of the gun barrel axially adjoining the drum, and which are connected with a main passageway in the hollow-bored longitudinal barrel axis for the central cooling medium infeed.

As a rule, difficult conditions are encountered by the gun barrel of an automatic firearm or a high-performance machine cannon during operational use thereof. In general, when there are to be fired only short firing bursts which are controlled by a firing count limiter, then there has also been ascertained that, for instance, the pilot of a combat aircraft must have the capability at any given instance of firing the entire ammunition supply in a single firing burst. Thereby there must be met at least the demands that towards the end of the firing burst there will not be endangered the operating personnel, and the aircraft encounters damage to its fuselage surfaces through shortened self-destructing periods, through rapidly reducing projectile speeds and through cross impacting projectiles.

Furthermore, there may not occur any gas backup and no duds may be encountered up to about 100 to 200 meters ahead of the mouth of the gun barrel. Furthermore, it is also important that the target sighting be adequately maintained.

2. Discussion of the Prior Art

In the mentioned high-performance firearms, which fire highly sophisticated ammunition, the extensive wear of the gun barrel can be always traced back in that the surface heat is not sufficiently rapidly dissipated. The rapid successively applied heat buildup during the firing burst produces surface stresses and material transformations. Due to the fluttering of the projectiles in the gun barrel the flutings are deformed and this leads to a removal of material through the guide band of the projectiles. In order to increase the life expectancy of the gun barrels, it has been proposed to conduct a cooling liquid about the gun barrel. Thus, for example, in U.S. Pat. No. 2,801,575 cooling water is conveyed through a main passageway to a battery of cooling conduits which extend radially from the drum axle, which are presently introduced into the drum between the projectile chambers and which connect with a cooling passageway presently extending in parallel with the drum axle. The heated cooling water is again discharged at the rearward drum end through a passageway system. In order to achieve a sufficient reduction in the heat through this indirect cooling, it is necessary to arrange a large number of cooling passageways within the drum. The entire cooling passageway system becomes thereby extremely complex, without leading to a desired optimum extent of cooling in precisely the bore of the barrel at the rearward portion of the gun barrel. Hereby, if at all possible, there should not be exceeded a temperature of about 400° C. on the bore surface of the gun barrel. In accordance with the proposal of this U.S. patent, the heat of vaporization is not employed.

SUMMARY OF THE INVENTION

Accordingly, it is an object of the present invention to provide a cooling arrangement of the above-mentioned type for the gun barrels of firearms, through which the life expectancy of the gun barrel is substantially improved since the temperature on the bore surface of the gun barrel is brought to below the transformation point for steel, and which can also be mass-produced through simple manufacturing means.

The foregoing object is inventively attained in that connected to the nozzles of the radially directed passageways, which nozzles extend essentially in parallel with the longitudinal axis of the drum, closure members are interposed in the radial cooling passageways which automatically open and close in dependence upon the drum position and only during firing, whereby the outlet openings of the nozzles positioned in the axial end surface of the drum and, during rotation of the drum, will presently openly communicate for a short period of time with the associated end portion of the gun barrel. By means of this advantageous construction, the cooling medium passes through the nozzles directly against the bore surface of the rearward portion of the gun barrel. Hereby, the nozzles are currently opened for only the time interval of the sliding past of the nozzle in the gun barrel rear portion, and the cooling medium infeed is only effected during firing. This avoids, in an advantageous manner, that cooling medium is sprayed into the cold gun barrel during a loading operation. The invention thus affords, with only minor technical demands and without an increase in the constructional volume of the drum, a fully effective cooling arrangement for that portion of the gun barrel which is particularly subjected to heat and gas pressure.

In order to control the infeed of cooling medium to the nozzles, in a modification of the invention the closure member can be a cylindrical slider which is longitudinally movable within the cooling passageway in the region of the nozzle inlet opening, which conforms with the cross-section of the cooling passageway, and has a tapered end surface extending radially out of the drum into operative engagement with the correspondingly shaped tapered surface of a control element which slides in a guide groove in the drum formed at right angles with the cooling passageway, and which has a rounded-off end portion opposite the tapered surface slidable along a cam on the gun barrel.

In a further embodiment of the invention, the closure member can consist of a valve stem which is longitudinally movably guided within a valve sleeve in the cooling passageway in the region of the nozzle inlet opening, which includes a valve disc standing under the pressure of a spring, whereby the valve stem can slide with its end portion which is located opposite the valve disc in the cam of a stationary control element arranged on the drum housing.

Further advantages can be ascertained in that the nozzles extend from a main bore at their outlet end so as to widen into a bundle of branching secondary bores. Thereby, the applied quantity of cooling medium is increased and, moreover, sprayed over a generally expanded surface.

Furthermore, an annular groove can be provided in the drum in which the control element is guided with clearance. For a satisfactory control function, the control element or the cam can be provided with inclined run-on and run-off surfaces. Finally, for the sealing of the firearm with respect to the entering cooling medium, seals can be arranged between the drum and the drum axle, as well as between the cooling passageway and slider, or the cooling passageway and the valve sleeve with the valve stem.

BRIEF DESCRIPTION OF THE DRAWINGS

Reference may now be had to exemplary embodiments of the invention as described in detail hereinbelow, taken in conjunction with the accompanying drawings; in which:

FIG. 1 illustrates a sectional view through the drum of a firearm with a gun barrel and incorporating the inventive cooling arrangement;

FIG. 2 is a sectional view taken along line II—II in FIG. 1 representing the nozzles with the gun barrel and the cam;

FIG. 3 is a sectional view taken along line III—III in FIG. 1 illustrating a cooling passageway with a slider;

DETAILED DESCRIPTION

Figure 4:
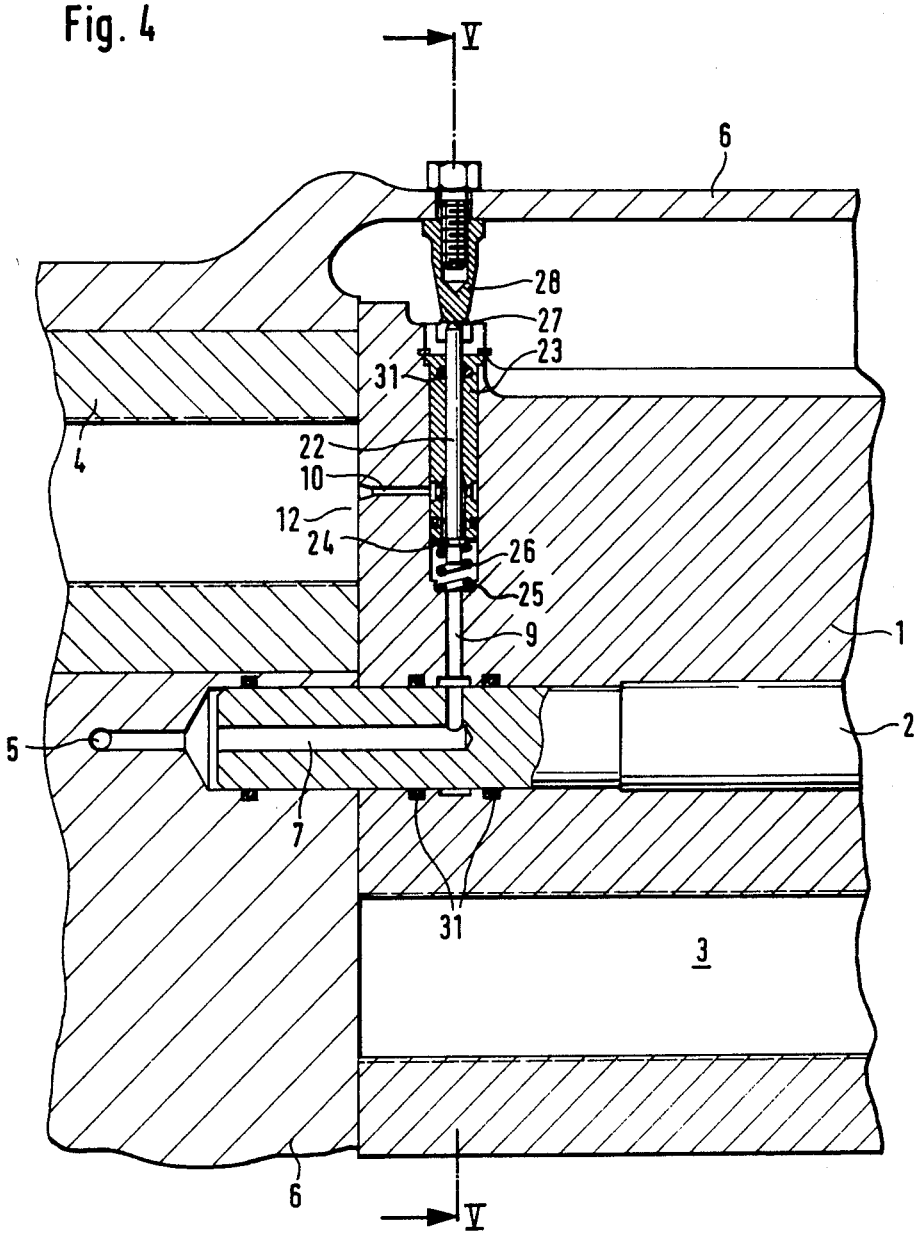
FIG. 4 is a sectional view through the drum of a firearm with a gun barrel and a modified embodiment of the inventive cooling arrangement.

The drum 1 of a high-performance machine cannon is supported for rotation about the drum axle 2 and includes projectile chambers 3 which are arranged in parallel with the drum axle 2 about a common circle. Hereby, the projectile chambers 3 are arranged at uniform spacings relative to each other. Attached axially to the drum 1 is the gun barrel 4, which is located at the same radial distance relative to the drum axle 2 as are the projectile chambers 3. The cooling medium passes through a cooling passageway 5 in the drum housing 6 into the central cooling passageway 7, which is formed through the hollow-bored drum axle 2. An annular passageway 8 extends about the drum axle 2 in the end region of the drum 1 ahead of the drum housing 6, or respectively, the gun barrel 4, which communicates with the central main passageway 7. Radial cooling passageways 9 in the drum 1 extend from the annular passageway 8 which are each centrally directed intermediate two projectile chambers 3. Nozzles 10 are arranged at right angles to the cooling passageways 9. These nozzles 10 are provided in the distance of the radius from the drum axle 2 relative to the central axis of the gun barrel 4 in a direction parallel with the drum axle 2. In order to attain an increased spraying area, and thereby a larger surface portion of the bore surface 11 of the gun barrel 4 in the rearward end portion 12 which is to be moistened with cooling medium, the nozzles which extend from a main bore 10*a*, are provided with secondary bores 10*b* extending therefrom at an angle. The nozzles 10 are open in the direction facing towards the gun barrel 4. Within the cooling passageways 9 there is arranged a slider 13 which is supported so as to be longitudinally movable, whose end portion 14 is provided with a tapered surface which is angled below 45° and which terminates radially against the mantel surface of the drum 1. The forward end, during the longitudinal movement, moves over the inlet openings 15 of the nozzle main bores 10*a*. A complementary surface of a control element 16 is an operative engagement with the tapered surface of the slider 13. The control element 16 is slidably inserted in a guide groove 17 which extends at right angles to the axis of the cooling passageway. The end portion 19 of the control element 16 which is located opposite the tapered surface 18 is rounded off at its head end and slides on a cam surface 20 which is machined into the axial end section of the gun barrel 4. The cam 20 is equipped with a run-on and a run-off incline 21. Its effective surface corresponds to the arcuate length beyond the projectile chambers 3.

Through the rotation of the drum 1 about the drum axle 2, the slider 13 is so displaced lengthwise due to the interaction with the control element 16, so that upon the nozzles 10 sliding by along the rearward end portion 12 of the gun barrel 4, the slider 13 will open the nozzles 10. The cooling liquid which stands under pressure in the cooling passageway 9 sprays against the bore surface 11 of the gun barrel 4. The duration of the injecting in the illustrated embodiment with five projectile chambers 3 consists of approximately 0.0055 seconds at an angle of rotation of the drum 1 during the injection of about 30 to 35 degrees. This provides for each shot a quantity of cooling liquid being injected into the gun barrel of approximately 2 cc. Achieved thereby is the intended object of obtaining a temperature in the rearward end portion of the gun barrel 4 of about 400° C.

Figure 5:
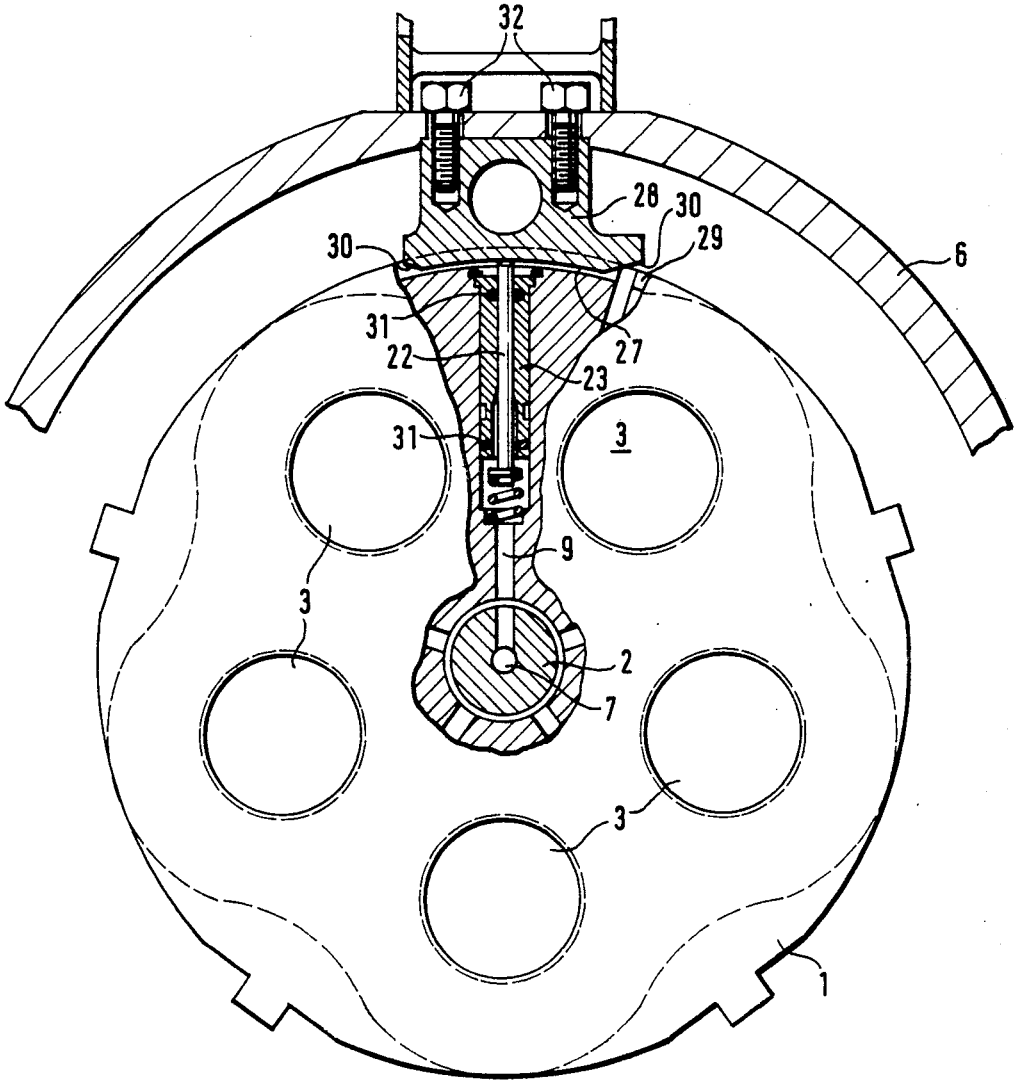
FIG. 5 is a sectional view taken along line V—V in FIG. 4 illustrating the valve in the radial cooling passageway.

The embodiment of FIGS. 4 and 5 relates to the same type of weapon. Merely the control of the cooling medium is solved in a different manner. Thus, the central main cooling passageway 7 is again arranged in the drum axle 2, from which there branch off radial cooling passageways 9 in the drum 1. The nozzles 10 extend in parallel with the drum axle and openly connect into the rearward end portion 12 of the gun barrel. Injection valves are built into the cooling passageways 9 in their longitudinal direction. These valves consist of a valve stem 22 which is guided for longitudinal movement in a valve sleeve 23 which is inserted into the cooling passageway 9. Fastened to the end of the valve stem 22 is a valve disc 24, which is acted on by a pressure spring 26 supported in the cooling passageway 9 against an annular shoulder 25. At the oppositely located end of the valve stem 22, the latter slides on a cam surface 27 of a control element 28 which is fixedly connected with the drum housing 6. In the exit region of the valve sleeve 23 there is formed a circumferential groove 29 in the mantel surface of the drum 1 in which the control element 28 is guided with a clearance. On the control element 28 there are further provided run-on and run-off inclines 30 for the cam 27.

In order to preclude any penetration of cooling liquid into the weapon, seals 31 are presently positioned between the drum 1 and the drum axle 2, as well as between the cooling passageway 9 and the slider 13, or the cooling passageway 9 and the valve sleeve 23 and the valve stem 22.

The function of the cooling medium control is similar to that as is described hereinabove with regard to the embodiment of FIGS. 1 through 3. During rotation of the drum 1 the valve stem 22 of each of the inserted valves slides once over the cam surface 27 of the control element 28, whereby the valve stem 22 is moved opposite the biasing action of the pressure spring 26 in a direction towards the drum axle 2. The valve disc 24 raises away from the contact surface, and the cooling liquid, during the sliding by of the present nozzle 10 along the rearward end of the gun barrel 4, sprays onto the bore surface 11 of the barrel.

The control element 28, which is fastened with cylinder screws 32 onto the drum housing 6, can be constructed for either the left-hand or the right-hand rotation of the drum 1.

We claim:

1. In a cooling arrangement for the gun barrels of firearms, including a rotatable drum having a longitudinal axle at the rearward portion of the gun barrel provided with passageways in the drum which passageways are directed radially outwardly intermediate individual projectile chambers which passageways are joined in the region of the end portion of the gun barrel axially adjoining the drum, a main passageway for a central cooling medium infeed located in a hollow bore along the longitudinal axle of said drum, said radial passageways being connected to said main passageway; the improvement comprising: cooling medium flow nozzles extending in predetermined angular relationship with the longitudinal axis of the drum and connecting with the radially directed cooling passageways; closure members in said radial passageways automatically opening and closing only during the firing of said firearm and in dependence upon the rotational drum position, said nozzles having outlet openings located in the axial end surface of the drum facing towards the gun barrel and openly communication for a predetermined time interval with the associated end portion of the gun barrel.

2. Cooling arrangement for gun barrels as claimed in claim 1, wherein said each said closure member comprises a longitudinally movable cylindrical slider positioned in each said radial cooling passageway in the region of an inlet opening for each said nozzle and being dimensioned in conformance with the cross-section of said passageway, said slider having a tapered surface radially extending from the drum; and a control element in said drum operatively associated with said slider, said control element having a corresponding formed tapered surface in operative engagement with said first-mentioned tapered surface, a guide groove formed in the drum at right angles to the radial cooling passageway for slidingly receiving said control element, said control element including a rounded-off end portion opposite the end having the tapered surface slidable along a cam surface formed on said gun barrel.

3. Cooling arrangement for gun barrels as claimed in claim 1, wherein each said closure member comprises a valve sleeve having a longitudinally movably guided valve stem therein, said valve stem being arranged in said radial cooling passageway in the region of an inlet opening of each said nozzle, a spring-biased valve disc mounted at one end of said valve stem, the end portion of the valve stem opposite the valve stem being slidable along a cam surface of a control element fixedly arranged on a drum housing of said drum.

4. Cooling arrangement for gun barrels as claimed in claim 2, wherein the cooling medium discharge ends of said nozzles disperse from a main bore into a bundle of secondary branch bores.

5. Cooling arrangement for gun barrels as claimed in claim 2, comprising an annular groove in said drum, said control element being guided in said groove with a clearance.

6. Cooling arrangement for gun barrels as claimed in claim 2, wherein said cam surface includes run-on and run-off inclines.

7. Cooling arrangement for gun barrels as claimed in claim 2, comprising seal means arranged between the drum and the longitudinal axle of the drum.

8. Cooling arrangement for gun barrels as claimed in claim 3, wherein said control element includes run-on and run-off inclines.

9. Cooling arrangement for gun barrels as claimed in claim 3, comprising seal means arranged between the drum and the longitudinal axle of the drum, and seal means between the cooling passageway and the valve sleeve and the valve stem.

* * * * *